US008334832B2

(12) United States Patent
Lee et al.

(10) Patent No.: US 8,334,832 B2
(45) Date of Patent: Dec. 18, 2012

(54) LIQUID CRYSTAL DISPLAY DEVICE AND DRIVING METHOD THEREOF

(75) Inventors: Sang Hoon Lee, Daegu (KR); Jae Won Hyun, Daegu (KR); Jong Woo Kim, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 706 days.

(21) Appl. No.: 12/314,260

(22) Filed: Dec. 5, 2008

(65) Prior Publication Data

US 2009/0146993 A1 Jun. 11, 2009

(30) Foreign Application Priority Data

Dec. 7, 2007 (KR) ..... 10-2007-0126530

(51) Int. Cl.
*G09G 3/36* (2006.01)

(52) U.S. Cl. ..... 345/99

(58) Field of Classification Search ..... 345/87, 345/98, 99, 204; 348/556
See application file for complete search history.

(56) References Cited

U.S. PATENT DOCUMENTS

| | | | | |
|---|---|---|---|---|
| 5,945,983 | A * | 8/1999 | Kanno et al. | 345/204 |
| 6,128,045 | A * | 10/2000 | Anai | 348/556 |
| 6,281,869 | B1 * | 8/2001 | Seino | 345/99 |
| 7,595,780 | B2 * | 9/2009 | Katagawa et al. | 345/87 |
| 7,903,070 | B2 * | 3/2011 | Moon et al. | 345/98 |

* cited by examiner

*Primary Examiner* — Chanh Nguyen
*Assistant Examiner* — James Nokham
(74) *Attorney, Agent, or Firm* — McKenna Long & Aldridge, LLP

(57) ABSTRACT

A driving method of an LCD device driving a liquid crystal display device including the steps of deriving a frame detection signal from a data enable signal by detecting a blank interval between frames deriving a start signal from the frame detection signal deriving a first gate clock signal from the start signal deriving a second gate signal from the first gate clock signal wherein a rising time of the first gate clock signal is in a range between a falling time of the start signal and a rising time of the second gate clock signal.

13 Claims, 13 Drawing Sheets

LIQUID CRYSTAL DISPLAY DEVICE AND DRIVING METHOD THEREOF

This application claims the benefit of Korean Patent Application No. 10-2007-0126530, filed on Dec. 7, 2007, which is hereby incorporated by reference for all purposes as if fully set forth herein.

BACKGROUND OF THE INVENTION

1. Field of the Invention

The present invention relates to a liquid crystal display device, and more particularly, to a liquid crystal display device adapted to improve a picture quality and a driving method thereof.

2. Discussion of the Related Art

As the information society spreads, flat display devices capable of displaying information have been widely developed. These flat display devices include liquid crystal display (LCD) devices, organic electro-luminescence display devices, plasma display devices, and field emission display devices. Among the above flat display devices, LCD devices have advantages that they are light and small and can provide a low power drive and a full color scheme. Accordingly, LCD devices have been widely used for mobile phones, navigation systems, portable computers, televisions and so on.

FIG. 1 is a block diagram showing a LCD device of related art, FIG. 2 is a detailed block diagram showing a gate driver in FIG. 1, and FIG. 3 is a circuitry diagram showing a first shift register in FIG. 2.

As shown in FIG. 1, the related art LCD device includes a liquid crystal panel 130, a gate driver 110, a data driver 120, and a timing controller 100. The liquid crystal panel 130 displays the pictures. The gate driver 110 drives the liquid crystal panel 130 by lines. The data driver 120 applies data voltages to the liquid crystal panel 130 by lines. The timing controller 100 controls the gate driver 110 and the data driver 120.

In order to control the gate driver 110 and the data driver 120, the timing controller 100 generates control signals. For example, the timing controller 100 generates a start signal Vst and first to fourth gate clock signals GCLK1 to GCLK4 to control the gate driver 110. The timing controller 100 also generates a source start pulse SSP, a source shift clock SSC, a source output enable signal SOE, a polarity control signal POL, and so on.

The first to fourth gate clock signals are sequentially generated, as shown in FIG. 4. The start signal Vst has the same high level interval as the fourth gate clock signal GCLK4. The first gate clock signal GCLK1 is identical with the second gate clock signal GCLK2 in a rising time.

The gate driver 110 is directly formed on the liquid crystal panel 130. Such a structure panel is called a Gate-in-Panel. The gate driver 110 is simultaneously manufactured with the liquid crystal panel 130.

The gate driver 110 includes a plurality of stages ST1 to STn. The stages ST1 to STn are connected to one another to form a cascade configuration. Each of the stages ST1 to STn receives an output signal of a previous stage and the three gate clock signals of the first to fourth gate clock signals GCLK1 to GCLK4 which are sequentially applied. The first stage ST1 independently inputs the start signal Vst instead of the previous stage's output signal, because the previous stage before it did not exist.

Each of the stage ST1 to STn uses the previous stage's output signal and the three gate clock signals of the first to fourth gate clock signals GCLK1 to GCLK4 and generates an output signal Vg1 to Vgn. The output signals Vg1 to Vgn generated in the stages ST1 to STn are applied to gate lines GL1 to GLn on the liquid crystal panel 130, respectively. Such stages ST1 to STn are identical with one another in their internal circuit configuration. Accordingly, for convenience of explanation, the circuit configuration of first stage ST1 will be now described.

Referring to FIG. 3, the fourth gate clock signal GCLK4 and the start signal Vst are applied to the first stage ST1. The first stage ST1 includes a first control portion 112 responsive to the start signal Vst and the fourth gate clock signal GCLK4, controlling a first node Q; a second control portion 114 responsive to the third gate clock signal GCLK3 and the start signal Vst, controlling a second node QB; and an output portion 116 responsive to voltages on the first and second nodes Q and QB, selectively outputting the first gate clock signal GCLK1 and a first supply voltage VSS.

The fourth gate clock signal GCLK4 turns on a second transistor T2 so that the start signal Vst is charged into the first node Q through a first transistor T1 and the second transistor T2, during a first interval. Then, a sixth transistor T6 is slowly turned on by the voltage on the first node Q. A fifth transistor T5 is also turned on so that the first supply voltage VSS is charged to the second node QB. The voltage VSS on the second node QB turns off third and seventh transistors T3 and T7. Accordingly, although the sixth transistor T6 is slowly turned on, the first gate line GL1 maintains a low level state due to the first gate clock signal GCLK1 of low level, during the first interval.

For a second interval, the start signal Vst and the first to fourth gate clock signal GCLK1 to GCLK4 are not applied. The status of the first stage ST1 in the first interval continues even for the second interval.

The first gate clock signal GCLK1 is applied to a source terminal of the sixth transistor T6 during a third interval. Then, a bootstrapping phenomenon is caused by an internal capacitor (or a parasitic capacitor) Cgs between the source and gate terminals of the sixth transistor T6, thereby increasing the voltage on the first node Q connected with the gate terminal of the sixth transistor T6. As a result, the sixth transistor T6 is fully or completely turned on so that the first gate clock signal GCLK1 of high level is charged on the first gate line GL1 of the liquid crystal panel 130 via the sixth transistor T6.

For a fourth interval, a second supply voltage VDD is charged to the second node QB through a fourth transistor T4 which is turned on by the third gate clock signal GCLK3. At this time, since the first gate clock signal GCLK1 has the low level, the bootstrapping phenomenon ceases so that the first node Q maintains the previous voltage, i.e., the voltage of the start signal Vst. The voltage on the second node QB turns on the third and seventh transistors T3 and T7, thereby charging the first supply voltage VSS to both of the first node Q and the first gate line GL1 of the liquid crystal panel 130 through each of the third and seventh transistors T3 and T7.

As described above, the start signal Vst and the first to fourth gate clock signals GCLK1 to GCLK4 should be applied from the timing controller 100 in order to drive the gate driver 110.

However, the related art LCD device enables both of the first and second gate clock signals GCLK1 and GCLK2 to go to the high level in the same rising time. In other words, even if the sixth transistor T6 connected to the first node Q is turned on by the start signal Vst and the fourth gate clock signal GCLK4, the first gate clock signal GCLK1 will not exist between the falling time of the start signal Vst and the rising time of the second gate clock signal GCLK2, so that the first gate clock signal GCLK1 of high level is not applied or charged to the first gate line GL1 of the liquid crystal panel 130. On the contrary, the other gate lines GL2 to GLn should have a sufficient precharging period. Accordingly, thin film transistors on the first gate line GL1 each have a relatively short turning-on interval to them on the other gate lines GL2 to GLn of the liquid crystal panel 130, thereby allowing pixels on the first gate line GL1 to be brighter than these on the other gate lines GL2 to GLn.

As a result, a brightness difference between the pixels of the first gate line GL1 and the pixels of the other gate lines GL2 to GLn is generated, thereby deteriorating the quality of pictures.

SUMMARY OF THE INVENTION

Accordingly, the present invention is directed to an LCD device that substantially obviates one or more of problems due to the limitations and disadvantages of the related art and a driving method thereof.

An advantage of the present invention is to provide an LCD device that modulates a first gate clock signal to shift its rising time ahead and minimizes the brightness difference between first gate line and the other gate lines so that the quality of picture improves, and a driving method thereof.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a driving method of a liquid crystal display device includes the steps of: deriving a frame detection signal from a data enable signal by detecting a blank interval between frames; deriving a start signal from the frame detection signal; deriving a first gate clock signal from the start signal; and deriving a second gate signal from the first gate clock signal, wherein a rising time of the first gate clock signal is determined in a range between a falling time of the start signal and a rising time of the second gate clock signal.

In another aspect of the present invention, an LCD device a frame detector deriving a frame detection signal from a data enable signal by detecting a blank interval between frames; a start signal generator deriving a start signal from the frame detection signal; a first gate clock signal generator deriving a first gate clock signal from the start signal; and a second gate clock signal generator deriving a second gate signal from the first gate clock signal, wherein a rising time of the first gate clock signal is determined in a range between a falling time of the start signal and a rising time of the second gate clock signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the embodiments and are incorporated in and constitute a part of this application, illustrate embodiment(s) of the invention and together with the description serve to explain the disclosure.

In the drawings.

DETAILED DESCRIPTION OF THE ILLUSTRATED EMBODIMENTS

Reference will now be made in detail to the embodiments of the present invention, examples of which are illustrated in the accompanying drawings. Wherever possible, the same reference numbers will be used throughout the drawings to refer to the same or like parts.

Figure 5:
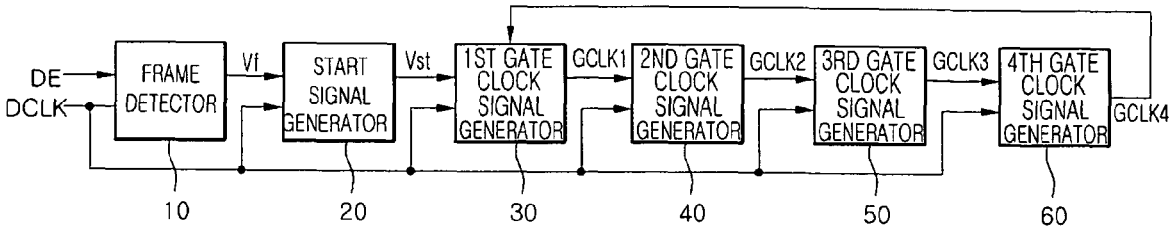
FIG. 5 is a block diagram showing a timing controller of LCD device according to an embodiment of the present disclosure.

FIG. 5 is a block diagram showing a timing controller of an LCD device according to an embodiment of the present disclosure. Referring to FIG. 5, the timing controller includes a frame detector 10, a start signal generator 20, and first to fourth gate clock signal generators 30, 40, 50 and 60.

Figure 6:
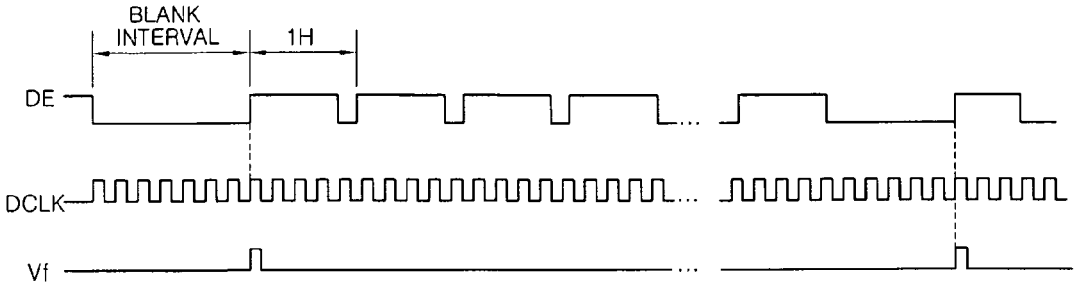
FIG. 6 is a waveform diagram explaining a frame detection signal generated in a frame detector shown in FIG. 5.

The frame detector 10 receives a data enable signal DE and a data clock signal DCLK, counts clocks included in the data clock signal DCLK, and detects a blank interval of the data enable signal DE on the basis of the counted clock value, as shown in FIG. 6. In other words, the data enable signal DE includes the blank interval between frame intervals. Also, the data enable signal DE includes horizontal intervals of high level periodically arranged within one frame interval. In accordance therewith, the frame detector 10 counts the clocks included in the data clock signal DCLK and determines an arbitrary interval that the data enable signal DE continuously maintains the low level until the counted clock value reaches to a constant value, as the blank interval. The frame detector 10 also detects a rising edge of the data enable signal DE which is changed from the low level to the high level and corresponds to the end position of the determined blank interval. Furthermore, the frame detector 10 generates the frame detection signal Vf which is in synchronization with the detected rising edge and is equal to the clock of the data clock signal DCLK in width. Alternatively, the width of the frame detection signal Vf can be larger or smaller than one clock of the data clock signal DCLK.

Figure 7:
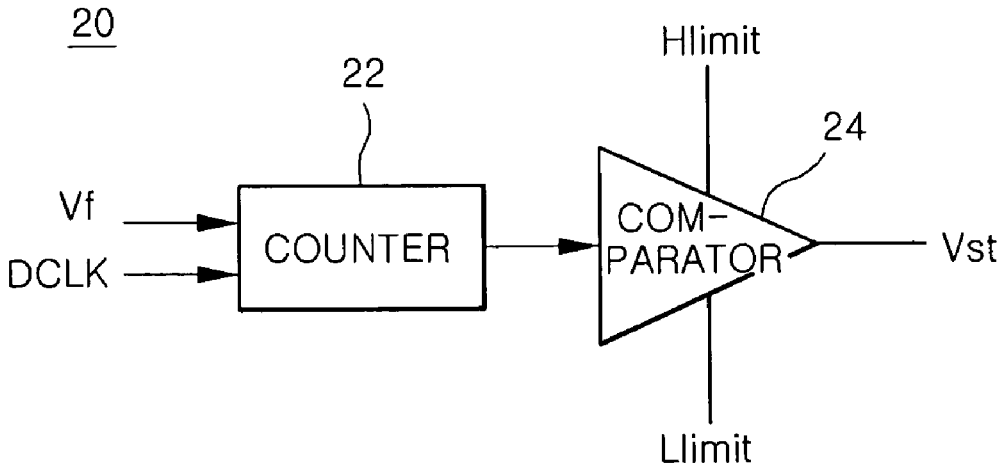
FIG. 7 is a detailed block diagram showing a start signal generator in FIG. 5.
Figure 8:
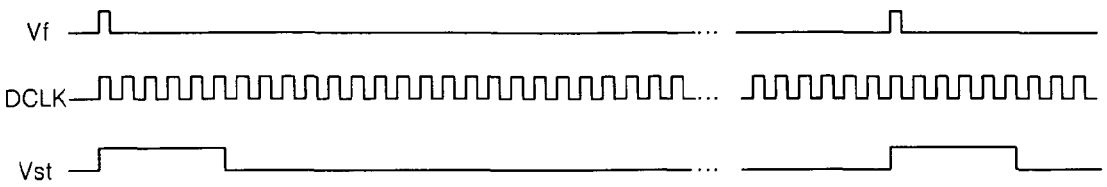
FIG. 8 is a waveform diagram explaining a start signal generated in a start signal generator shown in FIG. 5.

The start signal generator 20 receives the frame detection signal Vf from the frame detector 10 and the data clock signal DCLK. Such a start signal generator 20 includes a counter 22 and a comparator 24, as shown in FIG. 7.

The counter 22 depends on the frame detection signal Vf and counts the clocks of the data clock signal DCLK. The counted clock value in the counter 22 is applied to the comparator 24.

The comparator 24 generates the start signal Vst of high level which continues during a constant interval, on the basis of the counted clock value from the counter 22. This constant high level interval of the start signal Vst depends on low and high limit values Llimit and Hlimit. For example, the low limit value Llimit can be set up to designate a first clock of the data clock signal DCLK after the frame detection signal Vf. Also, the high limit value Hlimit can be set up to designate a sixth clock of the data clock signal DCLK after the frame detection signal Vf. In this case, the comparator 24 may generate the start signal Vst maintaining the high level during an interval from the first clock to the sixth clock of the data clock signal DCLK after the frame detection signal Vf. This start signal Vst is applied to the first gate clock signal generator 30.

Figure 9:
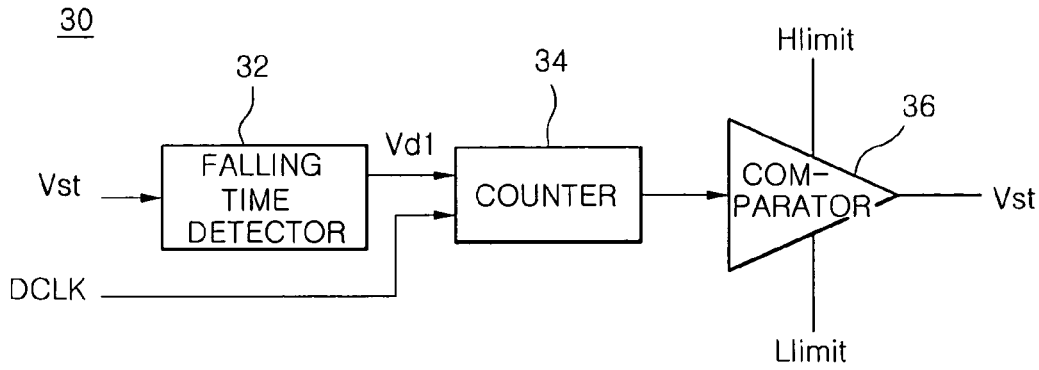
FIG. 9 is a detailed block diagram showing a first gate clock signal generator in FIG. 5.

The first gate clock signal generator 30 receives the start signal Vst from the start signal generator 20 and the data clock signal DCLK. The first gate clock signal generator 30 also includes a falling time detector 32, a counter 34, and a comparator 36, as shown in FIG. 9.

Figure 10:
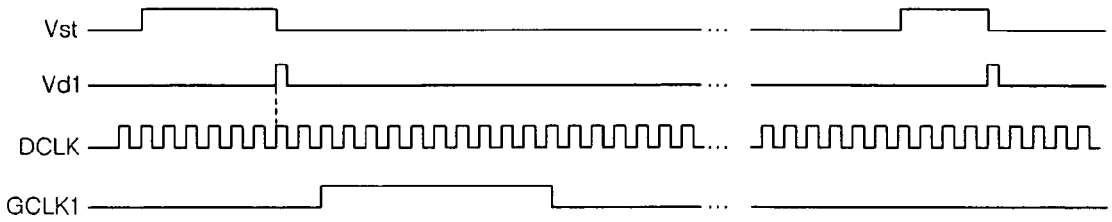
FIG. 10 is a waveform diagram explaining a first gate clock signal generated in a gate clock signal generator shown in FIG. 5.

The falling time detector 32 detects the falling time of the start signal Vst from the start signal generator 20 and generates a falling detection signal Vd1 as shown in FIG. 10. The falling detection signal Vd1 is in synchronization with the falling time of the start signal Vst and has the same width as one clock of the data clock signal DCLK. Alternatively, the width of the falling detection signal Vd1 can be larger or smaller than one clock of the data clock signal DCLK. Such a falling detection signal Vd1 is applied to the counter 34.

The counter 34 depends on the falling detection signal Vd1 from the falling time detector 32 and counts the clocks of the data clock signal DCLK. The counted clock value from the counter 34 is applied to the comparator 36.

The comparator 36 derives the first gate clock signal GCLK1 which maintains the high level during a constant interval, from the counted clock value. This high level interval can be determined in accordance with low and high limit values Llimit and Hlimit that are applied to the comparator 36.

For example, the low limit value Llimit can be set up to designate a third clock of the data clock signal DCLK after the falling detection signal Vd1. Also, the high limit value Hlimit can be set up to designate a thirteenth clock of the data clock signal DCLK after the falling detection signal Vd1. In this case, the comparator 36 may generates the first gate clock signal GCLK1 which maintains the high level during an interval from the third clock to the thirteenth clock of the data clock signal DCLK after the falling detection signal Vd1. The low and high limit values Llimit and Hlimit can be adjusted by the designer to fit the specifications of system. Similarly, the low limit value Llimit can be changed to designate a first clock of the data clock signal DCLK after the falling detection signal Vd1.

Consequently, the rising time of the first gate clock signal GCLK1 can be established as a time point between the first clock of the data clock signal DCLK after the falling detection signal Vd1 and the first clock of the data clock signal DCLK after the second gate clock signal GCLK2 described below. In other words, the rising time of the first gate clock signal GCLK1 may be set up within a range from the falling time of the start signal Vst to the rising time of the second gate clock signal GCLK2. This first gate clock signal GCLK1 is applied to the second gate clock signal generator 40.

Figure 11:
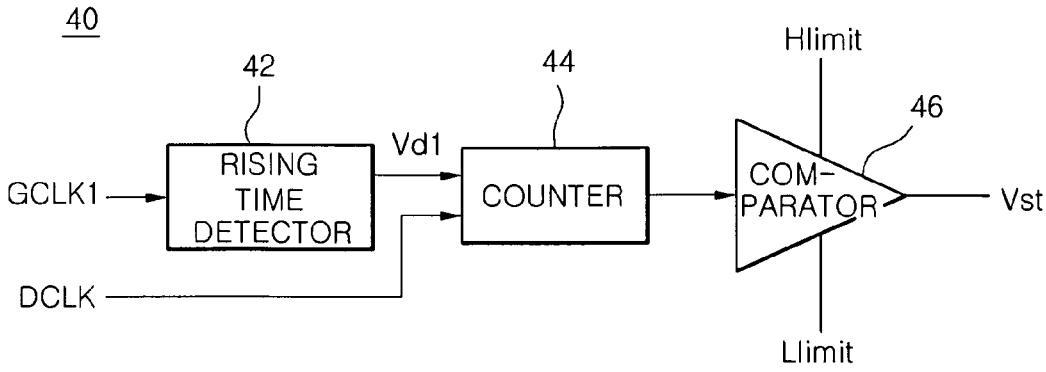
FIG. 11 is a detailed block diagram showing a second gate clock signal generator in FIG. 5.

The second gate clock signal generator 40 can include a rising time detector 42, a counter 44, and a comparator 46, as shown in FIG. 11.

Figure 12:
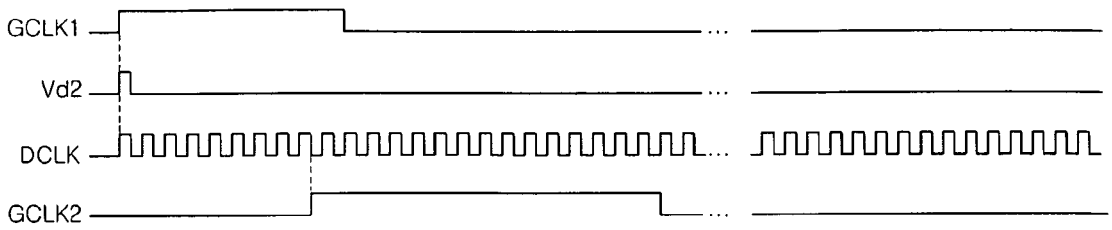
FIG. 12 is a waveform diagram explaining a second gate clock signal generated in a second gate clock signal generator shown in FIG. 5.

The rising time detector 42 detects the rising time of the first gate clock signal GCLK1 from the first gate clock signal generator 30 and generates a rising detection signal Vd2 shown in FIG. 12. The rising detection signal Vd2 is in synchronization with the rising time of the first gate clock signal GCLK1 and has the same width as one clock of the data clock signal DCLK. Alternatively, the width of the rising detection signal Vd2 can be larger or smaller than one clock of the data clock signal DCLK. This rising detection signal Vd2 is applied to the counter 44.

The counter 44 depends on the rising detection signal Vd1 from the rising time detector 42 and counts the clocks of the data clock signal DCLK. The counted clock number from the counter 44 is applied to the comparator 46.

The comparator 46 derives the second gate clock signal GCLK2 which maintains the high level during a constant interval, from the counted clock number. This high level interval can be determined in accordance with low and high limit values Llimit and Hlimit which are applied to the comparator 46.

For example, the low limit value Llimit can be determined to designate a tenth clock of the data clock signal DCLK after the rising detection signal Vd2. The high limit value Hlimit also can be determined to designate a twenty fourth clock of the data clock signal DCLK after the rising detection signal Vd2. In this case, the comparator 36 may generates the second gate clock signal GCLK2 maintaining the high level during an interval from the tenth clock to the twenty fourth clock of the data clock signal DCLK after the rising detection signal Vd2. The low and high limit values Llimit and Hlimit are adjusted by the designer to fit the specifications of system. Accordingly, the rising time of the second gate clock signal GCLK2 can be set up within the high level interval of the first gate clock signal GCLK1. This second gate clock signal GCLK2 is applied to the third gate clock signal generator 50.

Both the third gate clock signal generator 50 and the fourth gate clock signal generator 60 have the same circuit configuration as the second gate clock signal generator 40 and are identical to the second gate clock signal generator 40 in operation. The detailed explanations regarding the third and fourth gate clock signal generators 50 and 60 are described no longer.

The third gate clock signal generator 50 uses the second gate clock signal GCLK2 from the second gate clock signal generator 40 and the data clock signal DCLK and generates a third gate clock signal GCLK3. The third gate clock signal GCLK3 has a high level interval which is the same length as that of the second gate clock signal GCLK2 but is shifted from that of the second gate clock signal GCLK2 by a constant interval. The constant shifting interval is changed according to the specification of the system.

The fourth gate clock signal generator 60 derives a fourth gate clock signal GCLK4 on the basis of the third gate clock signal GCLK3 and the data clock signal DCLK. The fourth gate clock signal GCLK4 has a high level interval which is the same length as that of the third gate clock signal GCLK3 but is shifted from that of the third gate clock signal GCLK3 by a constant interval. The constant shifting interval can be changed according to the specification of the system.

The fourth gate clock signal GCLK4 is applied to the first gate clock signal generator 30 so that the first gate clock signal GCLK1 is derived from the fourth gate clock signal GCLK4 and the data clock signal DCLK and is applied to the second gate clock signal generator 40.

Figure 1:
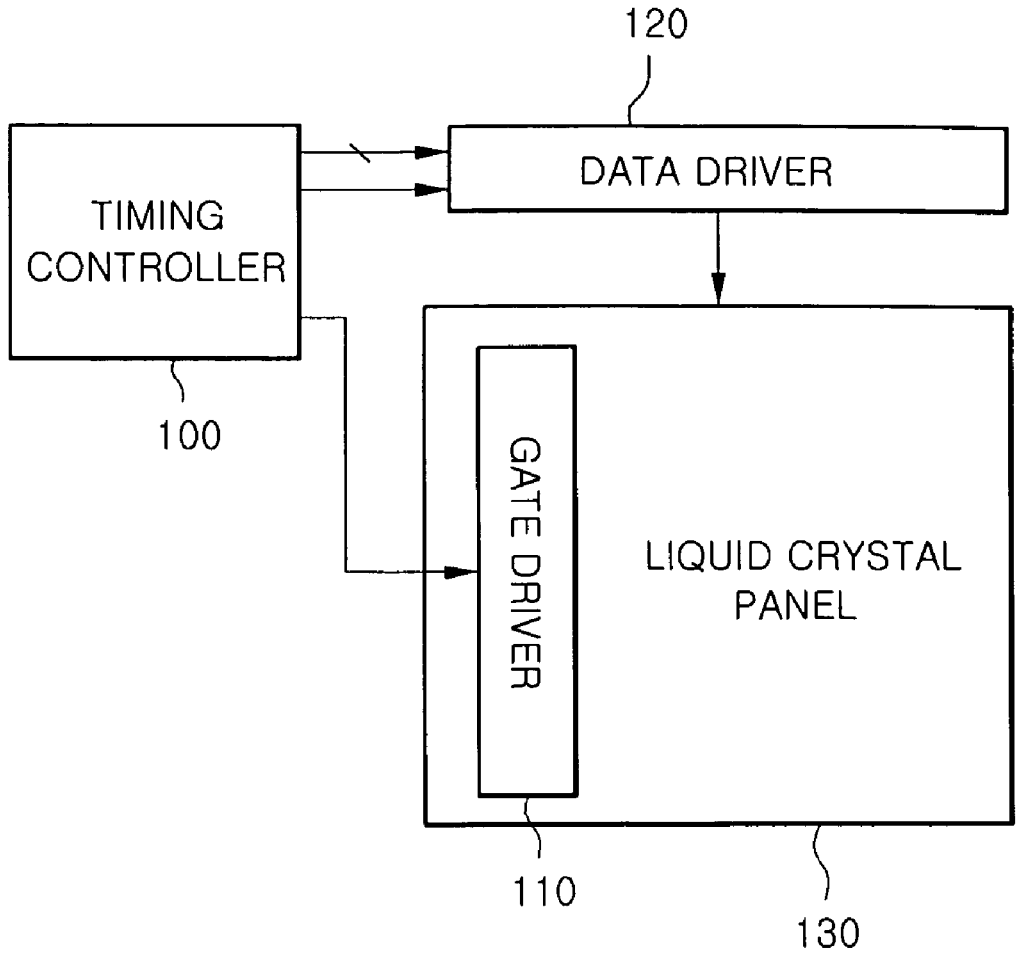
FIG. 1 (Related Art)
FIG. 1 is a block diagram showing an LCD device of related art.
Figure 2:
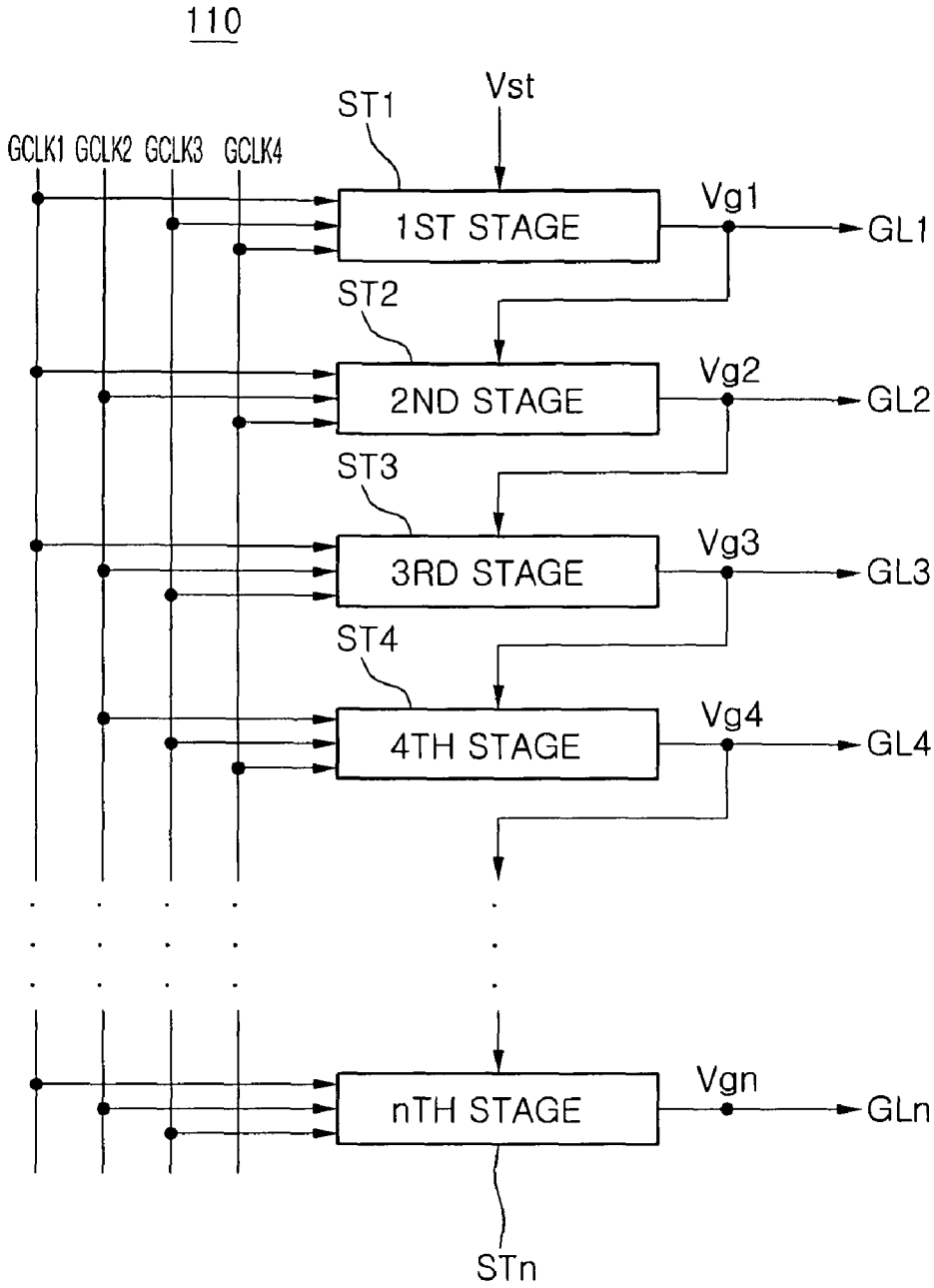
FIG. 2 (Related Art)
FIG. 2 is a detailed block diagram showing a gate driver in FIG. 1.
Figure 3:
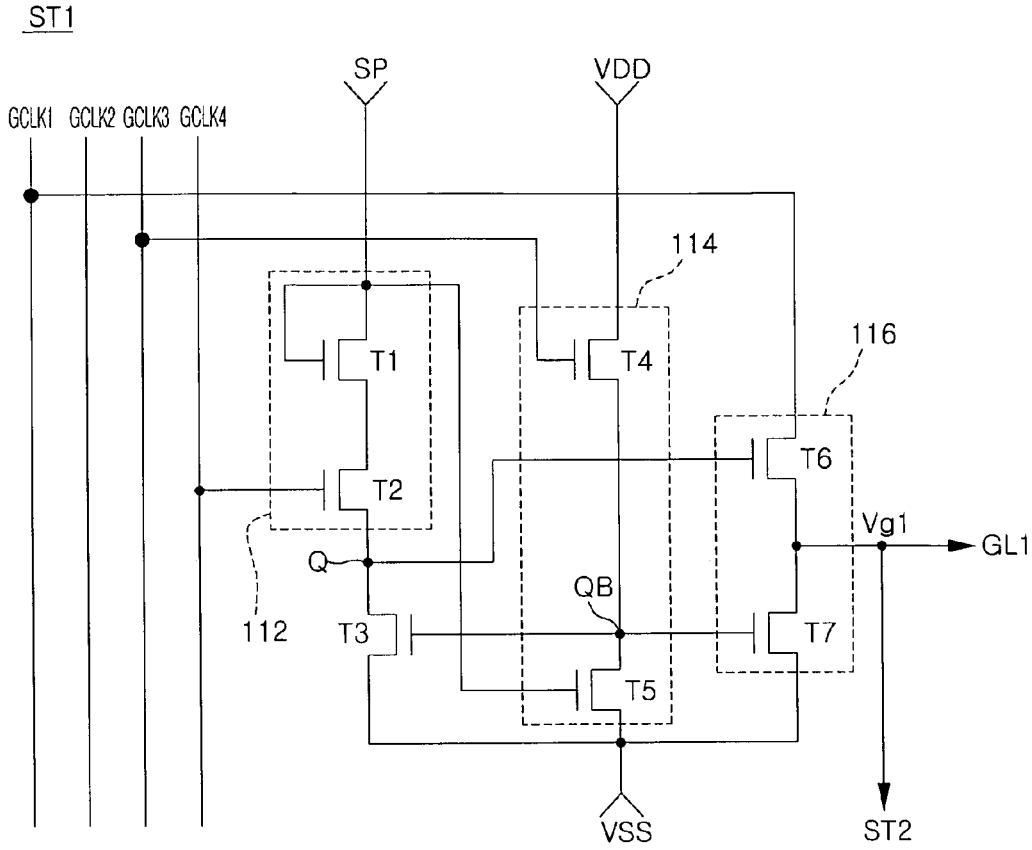
FIG. 3 (Related Art)
FIG. 3 is a circuitry diagram showing in detail a first stage in FIG. 2.
Figure 4:
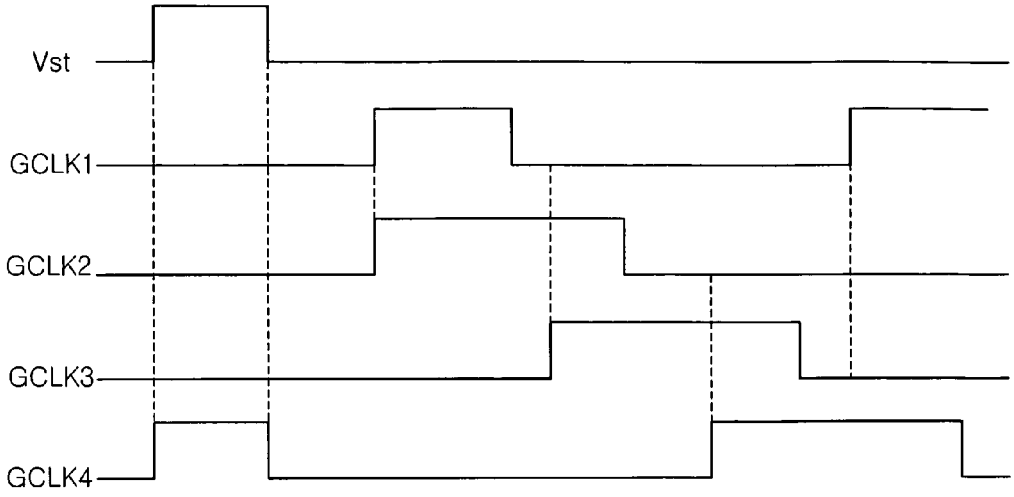
FIG. 4 (Related Art)
FIG. 4 is a waveform diagram showing control signals generated in a timing controller of FIG. 3.

In this manner, the operation of the first to fourth gate clock signal generators 30, 40, 50 and 60 described above allows the first to fourth gate clock signals GCLK1 to GCLK4 to be sequentially and repeatedly generated during one frame. The first to fourth gate clock signals GCLK1 to GCLK4 are applied to the gate driver of FIGS. 1 and 2, together with the start signal Vst. The stages of the gate driver is responsive to the start signal Vst and the first to fourth gate clock signals GCLK1 to GCLK4 and apply gate signals to the gate lines on the liquid crystal panel.

Figure 13:
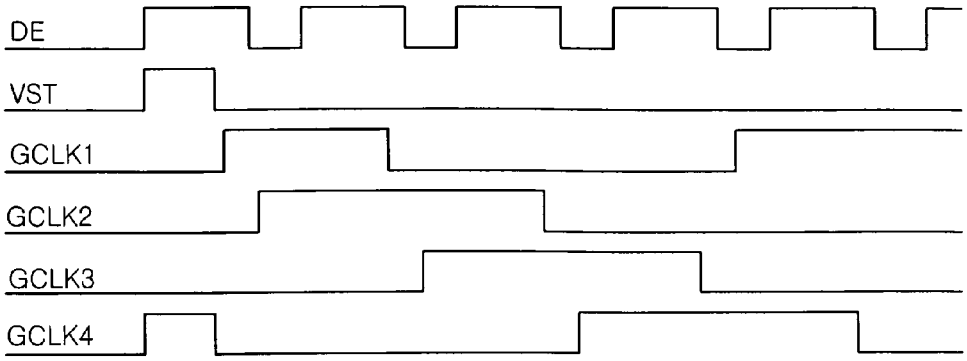
FIG. 13 is a waveform diagram explaining control signals generated in a timing controller of FIG. 5.

As shown in FIG. 13, the timing controller in the present invention set up the rising time of the first gate clock signal GCLK1 within the time range between the falling time of the start signal Vst and the rising time of the second gate clock signal GCLK2 so that the rising time of the first gate clock signal GCLK1 is shifted ahead of that of the related art. As a result, the first gate line GL1 on the liquid crystal panel has enough time to precharge so that the brightness difference between the first gate line GL1 and the other gate lines GL2 to GLn is minimized and the quality of picture is improved.

As described above, the LCD device according to the present embodiment sets up the rising time of the first gate clock signal GCLK1 within the time range between the falling time of the start signal Vst and the rising time of the second gate clock signal GCLK2. Accordingly, the rising time of the first gate clock signal GCLK1 is shifted ahead of that of the related art so that the first gate line GL1 on the liquid crystal panel has enough time to precharge. As a result, the brightness difference between the first gate line and the other gate lines can be minimized and the quality of picture can be improved.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method of driving a liquid crystal display device comprising the steps of:

deriving a frame detection signal from a data enable signal by detecting a blank interval between frames;

deriving a start signal from the frame detection signal;

deriving a first gate clock signal from the start signal; and deriving a second gate clock signal from the first gate clock signal, wherein the deriving of the first gate clock signal comprises the steps of:

detecting a falling time of the start signal to generate a falling detection signal;

counting clocks included in a data clock signal after the falling detection signal; and generating the first gate clock signal which has a high level during a second interval, on the basis of the counted value for the clocks of the data clock signal.

2. The method claimed as claim 1, wherein the deriving of the frame detection signal comprises the steps of counting clocks included in the data clock signal;

detecting the blank interval of the data enable signal on the basis of the counted clock value; and generating the frame detection signal in synchronization with the rising time of the data enable signal after the blank interval.

3. The method claimed as claim 2, wherein the blank interval is detected when the data enable signal is continuously in a low level until the counted clock value reaches a constant value.

4. The method claimed as claim 1, wherein the deriving of the start signal comprises the steps of:

counting clocks included in the data clock signal after the frame detection signal; and generating the start signal which has a high level during a first interval, on the basis of the counted value for the clocks of the data clock signal.

5. The method claimed as claim 4, wherein the first interval is determined in accordance with low and high limit values which designate respective clock numbers of the data clock signal after the frame detection signal.

6. The method claimed as claim 1, wherein a rising time of the first gate clock signal is in a range between the falling time of the start signal and a rising time of the second gate clock signal.

7. The method claimed as claim 6, wherein the second interval is determined in accordance with low and high limit values which designate respective clock numbers of the data clock signal after the falling detection signal.

8. The method claimed as claim 1, wherein the deriving of the second gate clock signal comprises the steps of:

detecting a rising time of the first gate clock signal to generate a rising detection signal;

counting the clocks of the data clock signal after the rising detection a signal; and generating the second gate clock signal which has the high level during a third interval, on the basis of the counted value for the clocks of the data clock signal.

9. The method claimed as claim 8, wherein the third interval is determined in accordance with low and high limit values which designate respective clock numbers of the data clock signal after the rising detection signal.

10. The method claimed as claim 1, further comprising the steps of:

deriving a third gate clock signal from the second gate clock signal; and deriving a fourth gate clock signal from the third gate clock signal.

11. A liquid crystal display device comprising:

a frame detector deriving a frame detection signal from a data enable signal by detecting a blank interval between frames;

a start signal generator deriving a start signal from the frame detection signal;

a first gate clock signal generator deriving a first gate clock signal from the start signal; and a second gate clock signal generator deriving a second gate clock signal from the first gate clock signal, wherein the first gate clock signal generator comprising:

a falling time detector configured to generate a falling detection signal from a falling time of the start signal;

a counter configured to count clocks included in a data clock signal after the falling detection signal; and a comparator configured to generate the first gate clock signal which has a high level during a second interval, on the basis of the counted value for the clocks of the data clock signal.

12. The device claimed as claim 11, further comprising:

a third gate clock signal generator deriving a third gate clock signal from the second gate clock signal; and a fourth gate clock signal generator deriving a fourth gate clock signal from the third gate clock signal.

13. The device claimed as claim 11 , wherein a rising time of the first gate clock signal is in a range between the falling time of the start signal and a rising time of the second gate clock signal.

* * * * *